US006997629B2

(12) United States Patent
Bungert et al.

(10) Patent No.: US 6,997,629 B2
(45) Date of Patent: Feb. 14, 2006

(54) SUPPLY ITEMS FOR PRINTERS AND THE LIKE, AND METHOD OF LOADING SUPPLY ITEMS

(75) Inventors: Lyle C. Bungert, Lakeville, MN (US); Brian Clemens, Chicago, IL (US); Brett Ryan Johnson, Roseville, MN (US); Jennifer Astwood, Robbinsdale, MN (US); Charles Austen Angell, Minneapolis, MN (US)

(73) Assignee: DataCard Corporation, Minnetonka, MN (US)

( * ) Notice: Subject to any disclaimer, the term of this patent is extended or adjusted under 35 U.S.C. 154(b) by 15 days.

(21) Appl. No.: 10/613,186

(22) Filed: Jul. 3, 2003

(65) Prior Publication Data

US 2004/0022572 A1 Feb. 5, 2004

Related U.S. Application Data

(60) Provisional application No. 60/400,370, filed on Jul. 31, 2002.

(51) Int. Cl.
*B41J 17/32* (2006.01)

(52) U.S. Cl. ..... 400/613; 400/693.1; 242/599; 242/597.6; 242/599.4; 242/600

(58) Field of Classification Search ..... 400/207, 400/208, 236, 246, 242, 693.1, 611, 613; 242/599, 597.6, 599.4, 600, 613, 609.1
See application file for complete search history.

(56) References Cited

U.S. PATENT DOCUMENTS

| | | | | |
|---|---|---|---|---|
| 3,604,549 A | | 9/1971 | Caudill et al. | |
| 4,468,139 A | | 8/1984 | Hattori | |
| 5,100,250 A | * | 3/1992 | Suzuki et al. | 400/208 |
| 5,695,292 A | | 12/1997 | Coote | |
| 5,755,519 A | | 5/1998 | Klinefelter | |
| 5,762,431 A | | 6/1998 | Pawelka et al. | |
| 6,082,914 A | | 7/2000 | Barrus et al. | |
| 6,099,178 A | | 8/2000 | Spurr et al. | |
| 6,109,801 A | | 8/2000 | Mabit | |
| 6,152,625 A | | 11/2000 | Oliverio | |
| 6,161,972 A | * | 12/2000 | Kameyama et al. | 400/208 |
| 6,257,780 B1 | * | 7/2001 | Ito et al. | 400/208 |
| 6,422,770 B1 | * | 7/2002 | de la Reguera | 400/208 |
| 6,595,710 B1 | * | 7/2003 | Hayashi | 400/208 |

FOREIGN PATENT DOCUMENTS

EP 0 769 762 A2 4/1997

OTHER PUBLICATIONS

"Pro/Pro-L Card Printer User's Manual," 11 pages (1998).
"User's Guide for P310 Printer, Eltron," Zebra Technologies Corporation, 46 pages (1999).

* cited by examiner

*Primary Examiner*—Ren Yan
*Assistant Examiner*—Kevin D. Williams
(74) *Attorney, Agent, or Firm*—Hamre, Schumann, Mueller & Larson, P.C.

(57) ABSTRACT

Improvements that facilitate loading of supply items into data bearing identification or financial document production equipment. Supply items include web materials that are used in data bearing identification or financial document production equipment, and which are supplied from a supply cylinder and wound onto a take-up cylinder after use. Examples of supply items include monochromatic and multi-color print ribbons, webs that carry laminate patches, cleaning tape, and other web materials that are used up during use of the equipment. Data bearing identification or financial document production equipment include thermal printers, laminators and combinations thereof, and other equipment that utilize supply items.

24 Claims, 10 Drawing Sheets

SUPPLY ITEMS FOR PRINTERS AND THE LIKE, AND METHOD OF LOADING SUPPLY ITEMS

This application claims the benefit of U.S. Provisional Application 60/400,370 filed Jul. 31, 2002.

FIELD OF THE INVENTION

The invention relates to printers, laminators and other equipment used to produce data bearing identification or financial documents, including plastic cards such as financial (e.g. credit and debit) cards, drivers' licenses, national identification cards, and other similar cards, as well other identification and financial documents, such as passports. In particular, the invention relates to supply items used in such equipment, and to a method of facilitating the loading of the supply items into the equipment.

BACKGROUND OF THE INVENTION

Identification and financial documents, such as financial (e.g. credit and debit) cards, drivers' licenses, national identification cards, and other cards, as well as passports and the like, are well known. These types of documents are often provided with data, graphics or a combination thereof composed of printed characters and/or images printed onto the documents using a printer. An example of a suitable printer for printing a card is disclosed in U.S. Pat. No. 5,762,431.

Many of these types of printers utilize a print ribbon that provides the ink or dye used to produce the data or graphics. These ribbons need to be replaced as they are used up. However, replacement of the ribbon can be difficult, especially for those who are inexperienced or unfamiliar with the printer. It is not unknown for operators of such printers to incorrectly position the take-up cylinder where the supply cylinder is intended to be positioned, and vice-versa, or to try to position the supply and take-up cylinders at incorrect positions within the printer. In addition, the supply and take-up cylinders can be positioned upside down in the printer so that the ribbon is in the wrong wind direction (e.g. unwound from the supply cylinder and wound onto the take-up cylinder from the bottom of the cylinders rather than from the top).

Similar difficulties exist for other supply items, for example webs that carry laminate patches, cleaning tape or ribbon, holographic overlays, and other exhaustible web materials, used in equipment for producing identification and financial documents.

There is a need for improvements to facilitate loading of supply items into data bearing identification or financial document production equipment.

SUMMARY OF THE INVENTION

The invention relates to improvements that facilitate loading of supply items into data bearing identification or financial document production equipment. Supply items include web materials that are used in data bearing identification or financial document production equipment, and which are supplied from a supply cylinder and wound onto a take-up cylinder after use. Examples of supply items include monochromatic and multi-color print ribbons, webs that carry laminate patches, cleaning tape or ribbon, holographic overlays, and other web materials that are used up during use of the equipment. Data bearing identification or financial document production equipment include thermal printers, laminators and combinations thereof, and other equipment that utilize supply items.

In one embodiment, a supply item for data bearing identification or financial document production equipment comprises a supply cylinder, a take-up cylinder, and a web material wound onto the supply cylinder and attachable to the take-up cylinder. The geometry of the take-up cylinder and the supply cylinder are different from each other so that either the take-up cylinder, the supply cylinder, or both, can only be inserted onto the proper spindle. In the preferred embodiment, the geometry of the take-up cylinder is such that it can only be mounted on the take-up spindle.

In another embodiment, a carrier for a supply item used in data bearing identification or financial document production equipment comprises a handle portion having first and second opposite end regions, a supply spindle rotatably mounted to the handle portion at the first end region, a first pin projecting past the end of the supply spindle, a take-up spindle rotatably mounted to the handle portion at the second end region, and a second pin projecting past the end of the take-up spindle. When viewed in an end plan view, the second pin has a geometry (e.g. a difference in size, shape, or both) that is different than a geometry of the first pin. The difference in geometry of the pins is preferably used in conjunction with features on the supply item so that loading of the supply item onto the carrier is made easier.

A method of facilitating loading of a supply item into data bearing identification or financial document production equipment comprises providing a carrier including a supply spindle assembly and a take-up spindle assembly; providing a supply item including a supply cylinder, a take-up cylinder, and a web material wound onto the supply cylinder and having an end thereof attached to the take-up cylinder. The supply cylinder is intended to be disposed on the supply spindle assembly and the take-up cylinder is intended to be disposed on the take-up spindle assembly. At least one of the supply cylinder and the take-up cylinder, and at least one of the supply spindle assembly and the take-up spindle assembly, are designed so that the supply cylinder or the take-up cylinder can only be disposed on the supply spindle assembly or the take-up spindle assembly respectively.

In another embodiment, data bearing identification or financial document production equipment is provided. The equipment includes a housing, a chassis disposed in the housing having first and second side walls defining a supply item receiving area therebetween that is adapted to at least partially receive a carrier having a supply spindle assembly with a supply cylinder received on the supply spindle assembly and a take-up spindle assembly with a take-up cylinder received on the take-up spindle assembly, with a web material wound onto the supply cylinder and having a take-up end thereof that is attached to the take-up cylinder. The first side wall includes first and second support structures for supporting ends of the supply spindle assembly and the take-up spindle assembly, respectively. In addition, the first support structure and the second support structure have different geometries to match different geometries of the supply spindle assembly and the take-up spindle assembly.

For a better understanding of the invention, its advantages and objects obtained by its use, reference should be made to the drawings which form a further part hereof, and to the accompanying description, in which there is described a preferred embodiment of the invention.

DETAILED DESCRIPTION OF THE INVENTION

Figure 1:
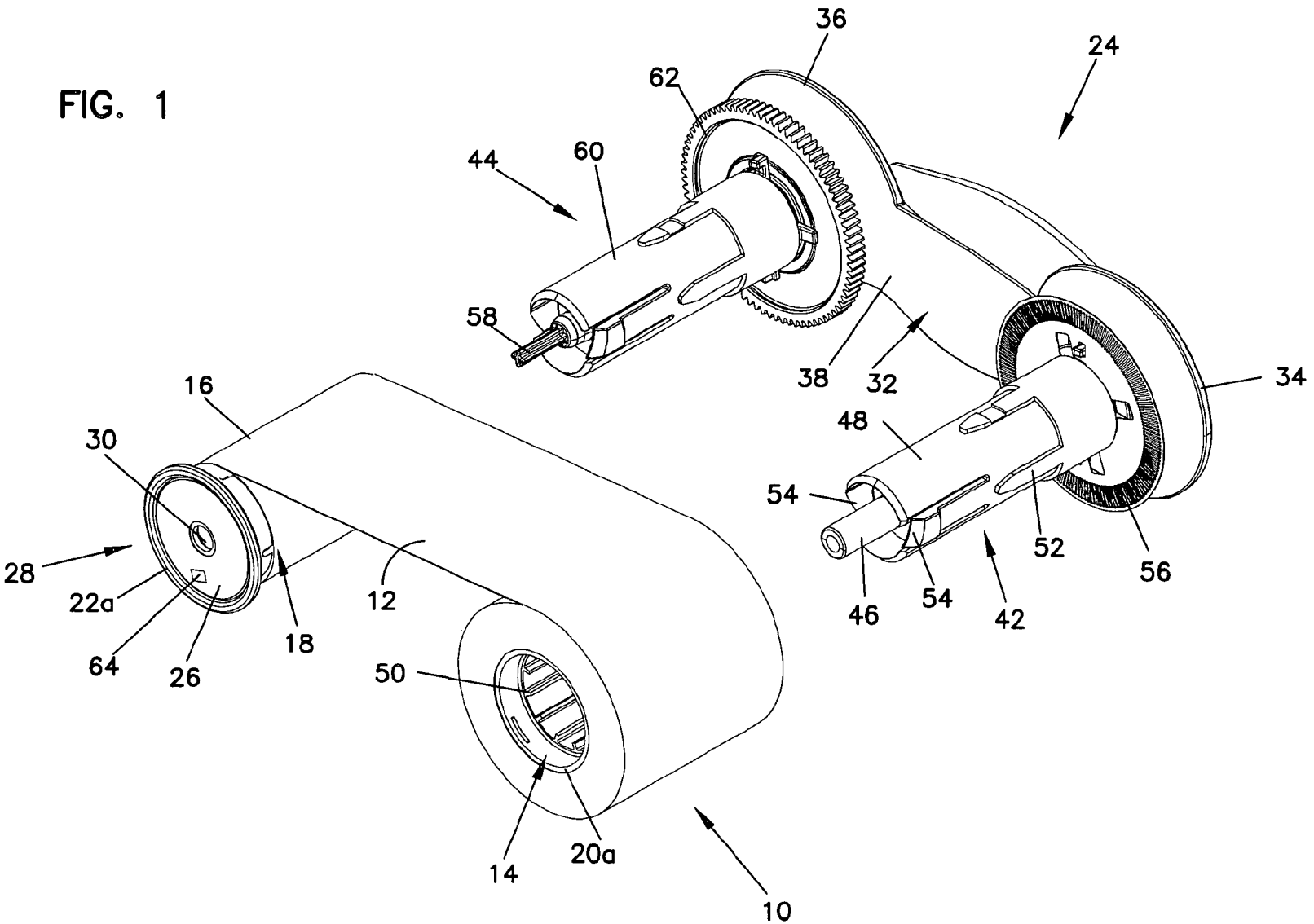
FIG. 1 is a perspective view illustrating an unused print ribbon supply item and a carrier for the print ribbon according to the principles of the present invention.

The invention relates to enhancements that facilitate loading of supply items into data bearing identification or financial document production equipment. The enhancements can be provided on the supply item itself, on a carrier that supports the supply item, on the production equipment, or on a combination thereof. Examples of supply items include monochromatic and multi-color print ribbons, webs that carry laminate patches, cleaning tape or ribbon, holographic overlays, and other web materials that are used up during use of the equipment. Data bearing identification or financial document production equipment include thermal printers, laminators and combinations thereof, and other equipment that utilize supply items.

The supply item and the carrier are modified to facilitate loading of the supply item onto the carrier in the proper orientation, and the carrier can be more easily loaded into the production equipment in the correct orientation. A variety of modifications can be utilized to achieve these goals. The preferred modification will be discussed in detail below.

For the sake of convenience, the supply item in the preferred embodiment will be described in relation to a multi-color print ribbon, and the production equipment will be described as a thermal printer that utilizes the supply item. However, it is to be realized that the concepts described herein are applicable to other supply items and other production equipment.

A print ribbon supply item 10 according to the invention is best seen in FIGS. 1–4. The supply item 10 includes a print ribbon 12, preferably a multi-color print ribbon, that supplies the dye or ink used in the printing process. The ribbon 12 is wound onto a supply cylinder 14 that is cylindrical in shape. The ribbon 12 includes a take-up end 16 that is attached to a take-up cylinder 18 that is cylindrical in shape and upon which used ribbon is wound. In FIGS. 1–4, the ribbon 12 is illustrated as being unused, with substantially the entire extent thereof wound onto the supply cylinder 14, and the end 16 of the ribbon 12 attached to the take-up cylinder 18 ready to take-up used ribbon.

The supply cylinder 14 includes first and second ends 20*a*, 20*b* and is generally hollow from the first end to the second end. Likewise, the take-up cylinder 18 includes first and second ends 22*a*, 22*b* and is generally hollow from the first end to the second end. Preferably, the ends 20*a*, 20*b*, 22*a*, 22*b* of the cylinders 14, 18 are designed to facilitate loading of the cylinders 14, 18 onto a carrier 24 (to be later described in detail) in the proper orientation, thereby simplifying ribbon replacement. More preferably, a difference in the geometry of the ends of the cylinders 14, 18 is used to achieve the simplified replacement.

Figure 3:
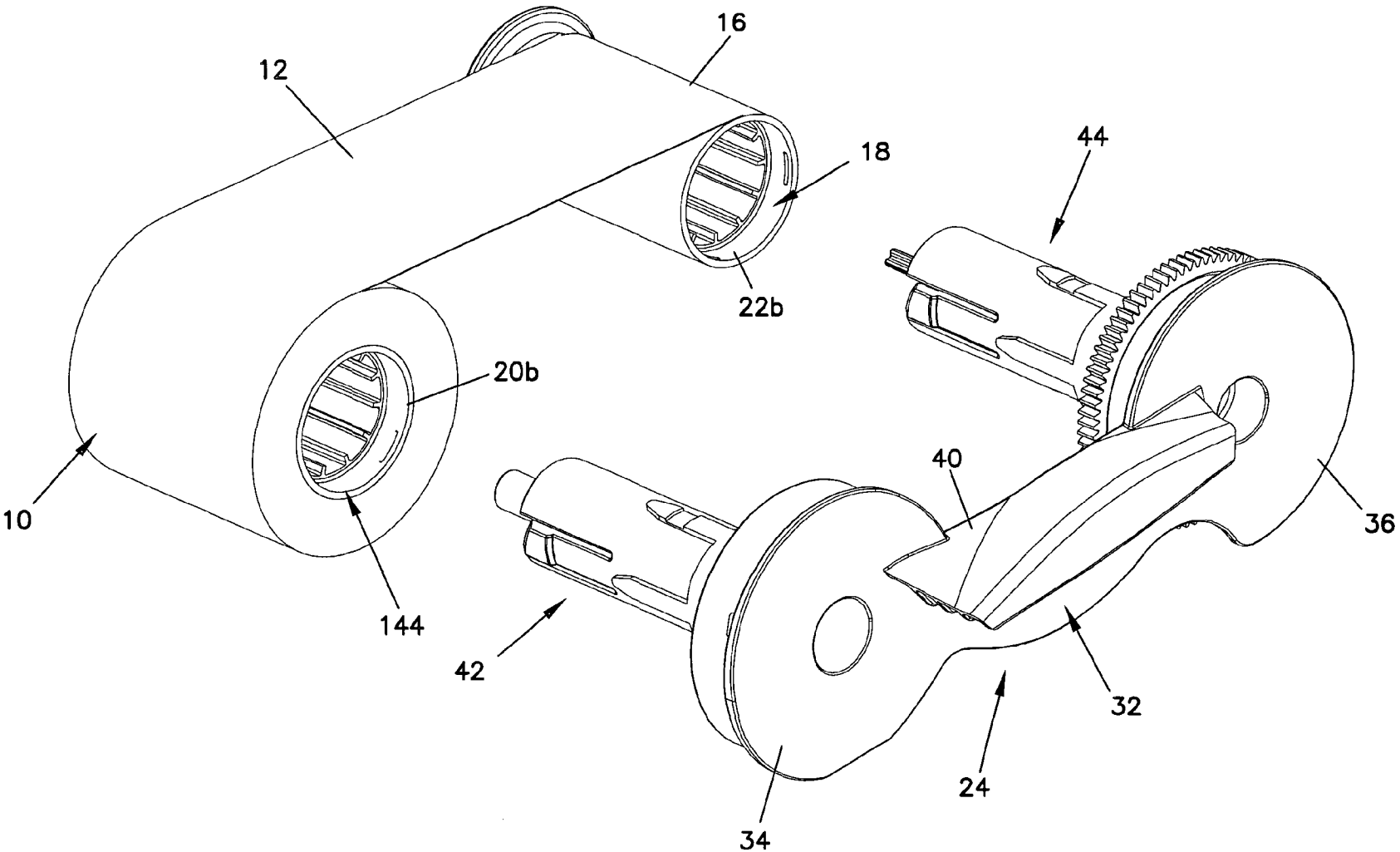
FIG. 3 is another perspective view of the unused print ribbon supply item and carrier.

With reference to FIGS. 1 and 3, the ends 20*a*, 20*b* of the cylinder 14 each define an opening having an area, with the area of the opening at the end 20*a* being substantially equal to the area of the opening at the end 20*b*. In addition, the ends 22*a*, 22*b* of the cylinder 18 each define an opening having an area. However, the end 22*a* of the cylinder 18 is closed by a wall 26 that forms part of a cap 28 that is connected to the end 22 of the cylinder 18. An opening 30 is provided in the wall 26. Thus, the area of the opening 30 at the end 22*a* is different than the area of the opening at the end 22*b*, and the area of the opening 30 is different than the area of the opening at the end 20*a* of the cylinder 14.

Figure 9:
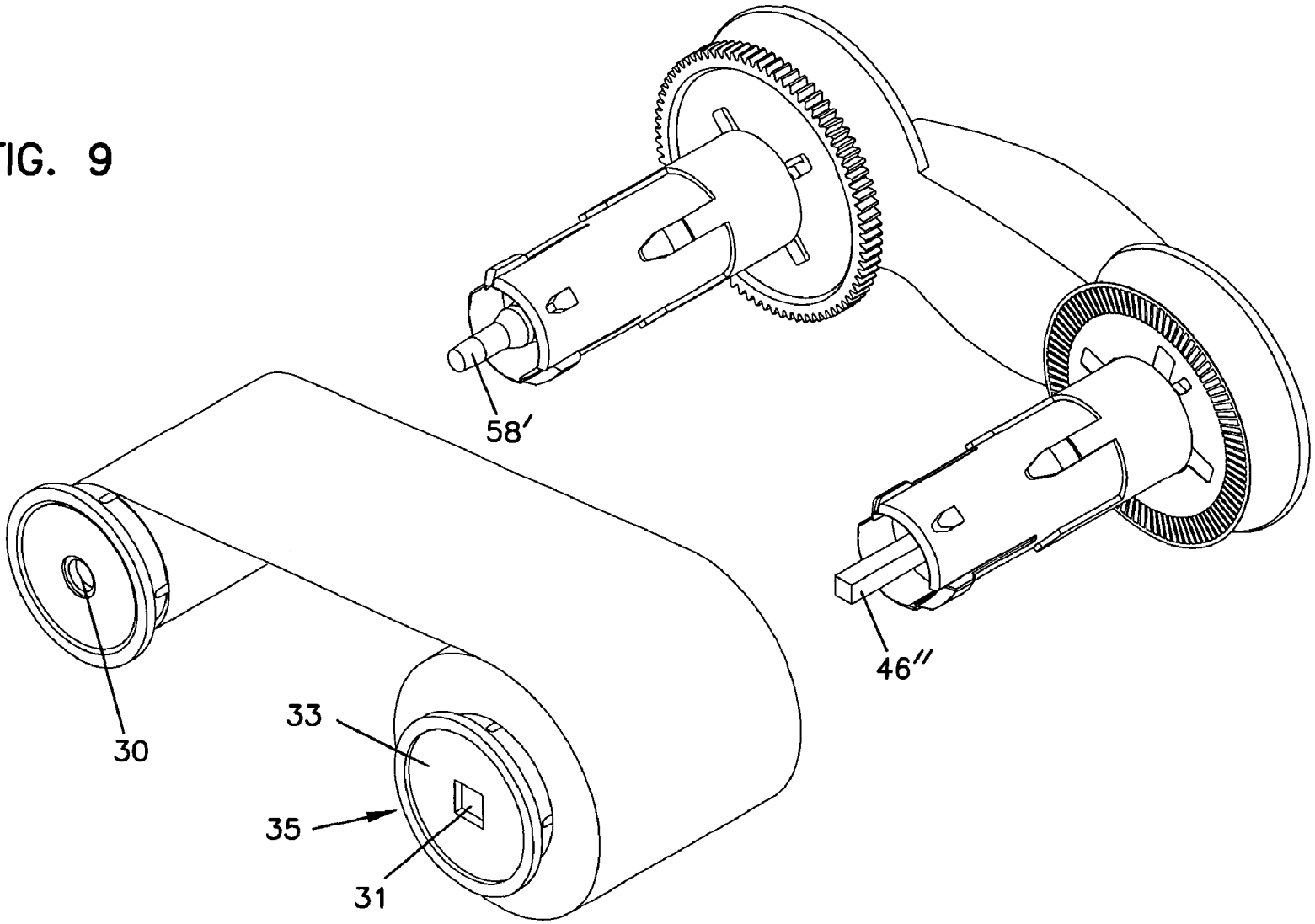
FIG. 9 illustrates another alternative embodiment of the carrier.

The difference in the geometry of the openings at the ends 20*a*, 22*a* of the cylinders 14, 18 limit how the cylinders 14, 18 can be connected to the carrier 24. While the end of the cylinder 18 is described as having an opening 30 with an area less than the opening at the end of the cylinder 14, it is to be realized that the reduced area opening can be provided on the cylinder 14 rather than on the cylinder 18. In addition, each cylinder could be provided with a reduced area opening, as illustrated in FIG. 9, so that the supply and take-up cylinders can only be disposed on the carrier in one orientation.

The carrier 24 forms a structure upon which the cylinders 14, 18 and ribbon 12 can be mounted, and which can then be inserted into the printer. With continued reference to FIGS. 1–4, the carrier 24 includes a handle portion 32 disposed between opposite end regions 34, 36. The handle portion 32 and end regions 34, 36 are preferably formed of plastic to reduce the weight of the carrier 24. The end regions 34, 36 are generally circular in shape, and have diameters that are greater than the diameters of the cylinders 14, 18.

Figure 4:
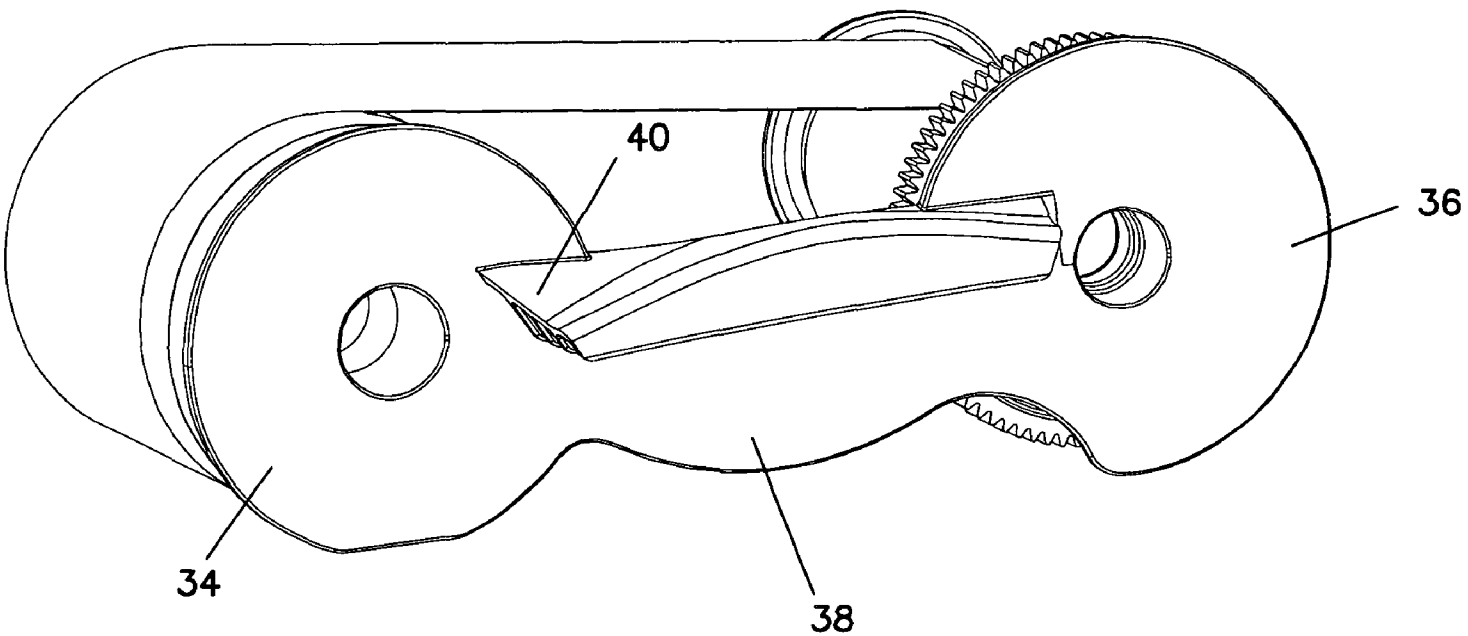
FIG. 4 illustrates the print ribbon supply item positioned on the carrier from the handle side of the carrier.

With reference to FIGS. 3 and 4, the handle portion 32 comprises a connecting plate 38 that connects the end regions 34, 36. A plate 40 projects substantially perpendicularly from the plate 38 and from the end regions 34, 36. The plate 40 includes an upper surface that is curved upward, with the plate 40 forming a handle by which the carrier 24 can be carried in a persons hand.

The carrier 24 includes a supply spindle assembly 42 that projects perpendicularly from the end region 34 and a take-up spindle assembly 44 that projects perpendicularly from the end region 36, as best seen in FIGS. 1 and 3. The spindle assemblies 42 and 44 form means to support the cylinders 14, 18, respectively, and form means to determine which cylinder 14, 18 can be disposed on which spindle assembly.

The spindle assembly 42 comprises a pin 46 and a supply spindle 48 surrounding the pin 46. The length of the spindle 48 and the length of the pin 46 are chosen such that the free end of the pin 46 projects past the end of the spindle 48, as shown in FIGS. 1 and 3. The spindle 48 is rotatably mounted on the pin 46 so that the spindle 48 can rotate relative to the pin 46. Alternatively, the spindle 48 and pin 46 can be designed to rotate together if desired. Either configuration is possible, as long as the pin 46 projects past the end of the spindle 48.

The spindle 48 is designed to receive the cylinder 14 thereon in such a manner that the cylinder 14 and spindle 48 rotate together with little or no relative rotation therebetween. Rotation between the cylinder 14 and the spindle 48 is prevented by ribs 50 provided on the interior surface of the cylinder and ribs 52 on the outer surface of the spindle 48. Resilient fingers 54 at the end of the spindle 48 snap over the ends of the ribs 50 on the cylinder 14, which are recessed from the end 20*a* of the cylinder 14, to fasten the cylinder 14 to the spindle 48. This type of connection mechanism between the cylinder 14 and spindle 48 is known in the art.

At the opposite end of the spindle 48, i.e. the end adjacent the handle portion 32, an apertured disk 56 is connected to the spindle for rotation therewith. The disk 50 forms part of a mechanism, well know in the art, to monitor movements of the spindle 48 and thus movements of the supply cylinder 14 to be mounted thereon. The disk 56 is preferably spaced from the end region 34 to provide a space therebetween.

The spindle assembly 44, like the spindle assembly 42, includes a pin 58 and a take-up spindle 60 surrounding the pin 58. The length of the spindle 60 and the length of the pin 58 are chosen such that the free end of the pin 58 projects past the end of the spindle 60, as shown in FIGS. 1 and 3. The spindle 60 is rotatably mounted on the pin 58 so that the spindle 60 can rotate relative to the pin 58. Alternatively, the spindle 60 and pin 58 can be designed to rotate together if desired. Either configuration is possible, as long as the pin 58 projects past the end of the spindle 60.

The spindle 60 is designed to receive the take-up cylinder 18 thereon in such a manner that the cylinder 18 and spindle 60 rotate together with little or no relative rotation therebetween. The connection between the cylinder 18 and spindle 60 is similar to the connection between the cylinder 14 and spindle 48. At the opposite end of the spindle 60, i.e. the end adjacent the handle portion 32, a gear 62 is connected to the spindle 60 for rotation therewith. The gear 62 is designed to be driven via a suitable driving mechanism to rotate the spindle 60 and thus the cylinder 18 to take-up used ribbon during use of the printer.

Figure 2A:
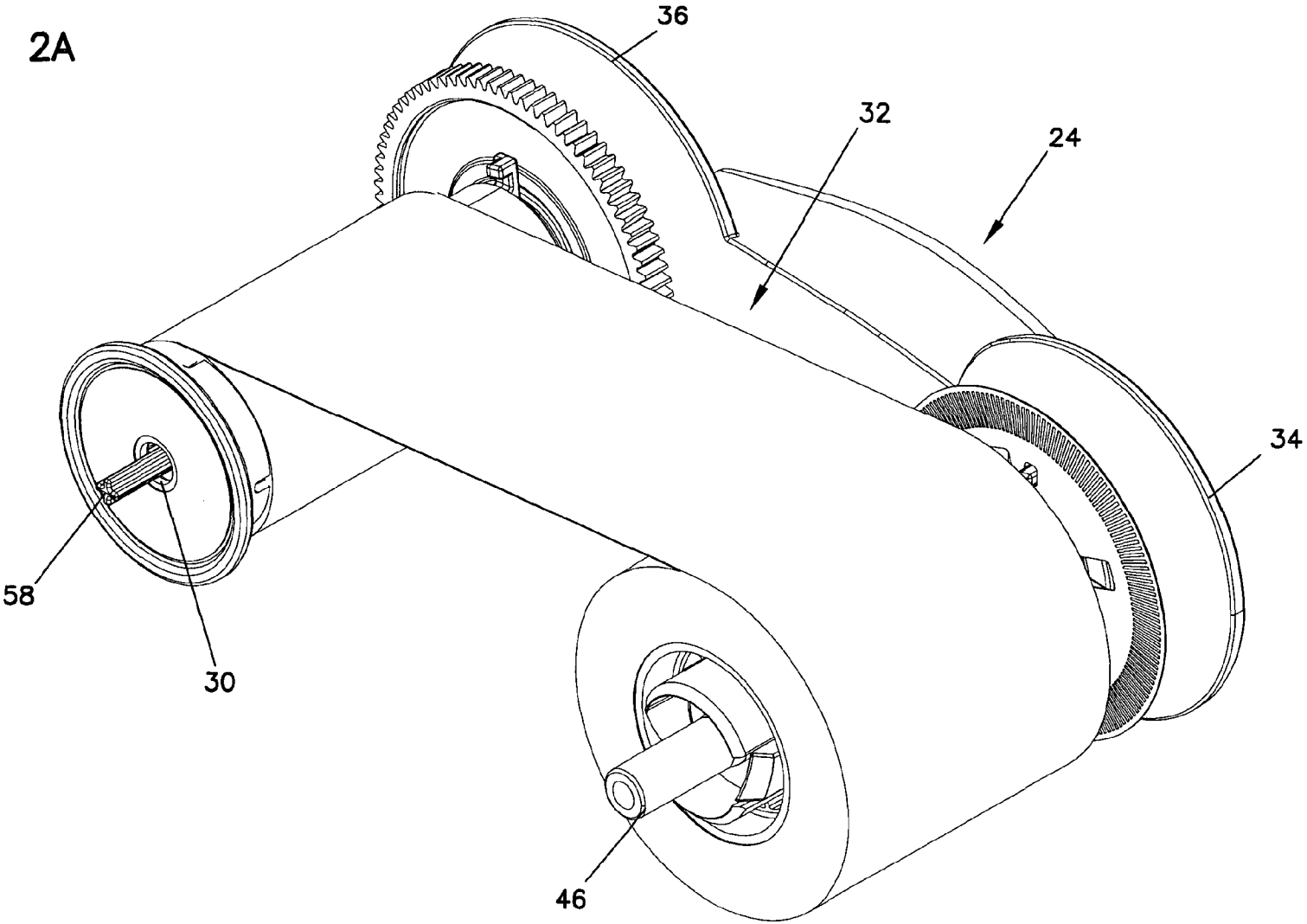
FIG. 2A is a perspective view illustrating the print ribbon supply item positioned on the carrier from the spindle side of the carrier.
Figure 2B:
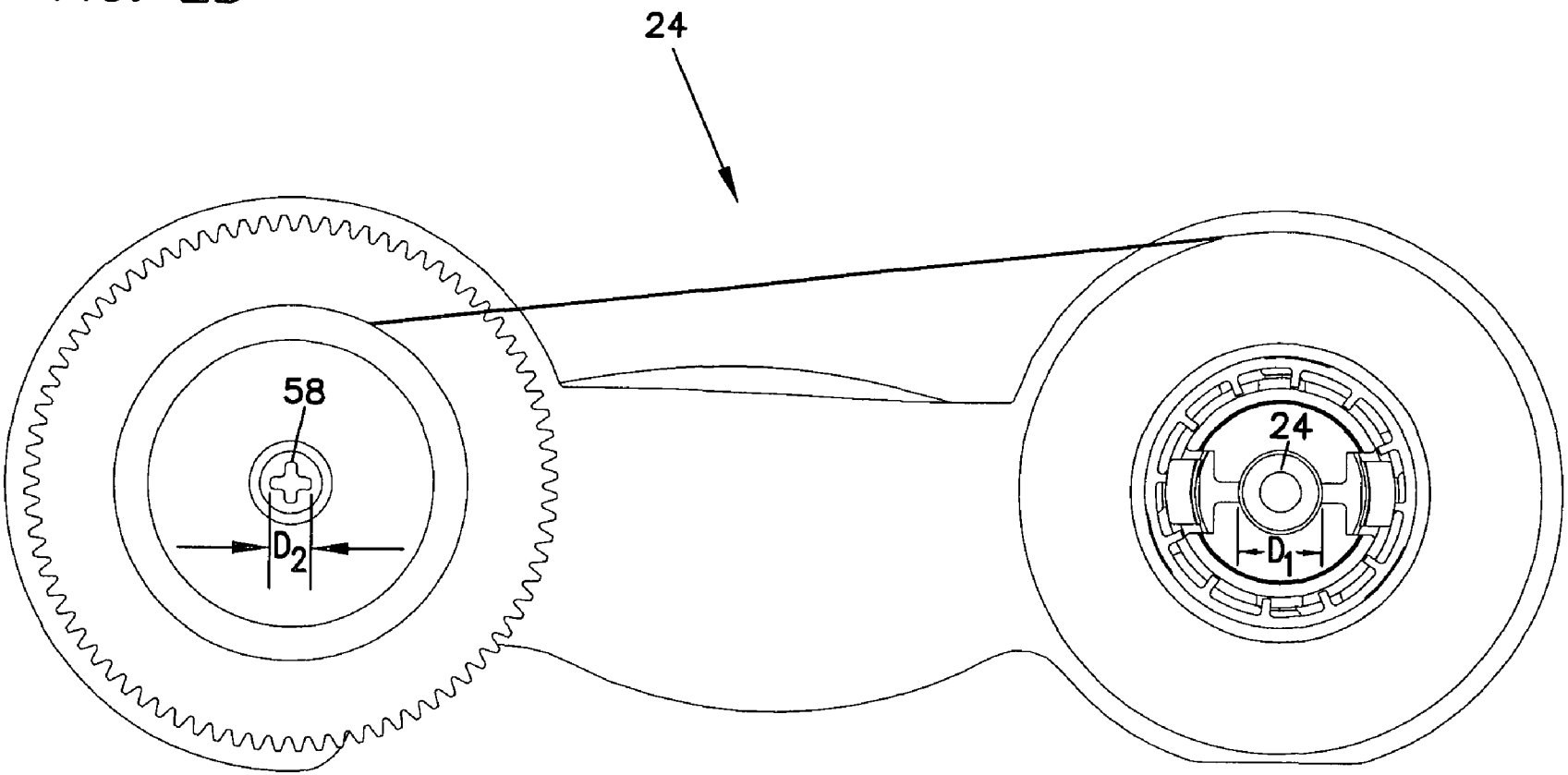
FIG. 2B is an end plan view from the spindle side of the carrier.

As best seen in FIGS. 1, 2A and 2B, the end of the pin 46 that projects past the end of the spindle 48 and the end of the pin 58 that projects past the end of the spindle 60 have different geometries from each other. As used herein, different geometries includes differences in sizes, differences in shapes, and combinations of different sizes and shapes.

In the embodiment illustrated in FIG. 1, the free end of the pin 46 is generally cylindrical so that, when viewed in an end plan view (FIG. 2B), the pin 46 is generally circular. The maximum dimension $D_1$ (e.g. the diameter for a cylindrical pin or other appropriate effective maximum dimension) of the pin 46 is such that the free end thereof cannot fit through the hole 30 defined in the end 22*a* of the cylinder 18. In contrast, the free end of the pin 58 is generally fluted so that, when viewed in an end plan view (FIG. 2B), the pin 58 is generally in the shape of a plus (+) sign, and the maximum dimension $D_2$ (i.e. the length of one of the legs defining the plus sign or other effective diameter for other shapes) of the pin 58 is such that the free end thereof is able to fit through the hole 30. The free end of the pin 58 could instead be cylindrical, but of a diameter that is different from the pin 46.

Thus, at least the size of the free ends of the pins 46, 58 are different, and, in the illustrated embodiment, both the size and shape of the free ends are different. With this construction, if one attempts to insert the take-up cylinder 18 onto the spindle 48 regardless of the orientation of the ends 22*a*, 22*b* of the cylinder, interference between the free end of the pin 46 and the hole 30 prevents such insertion. Likewise, if one attempts to reverse the cylinder 18 and slide the end 22*a* of the cylinder 18 over the spindle 60, interference between the spindle 60 and the hole 30 prevents insertion in this orientation. Therefore, the only way for the cylinder 18 to be inserted onto the spindle 60, while maintaining proper ribbon orientation, is in the orientation illustrated in FIGS. 1–7 with the end 22*b* of the cylinder 18 adjacent the end region 36 of the carrier 24.

Figure 8:
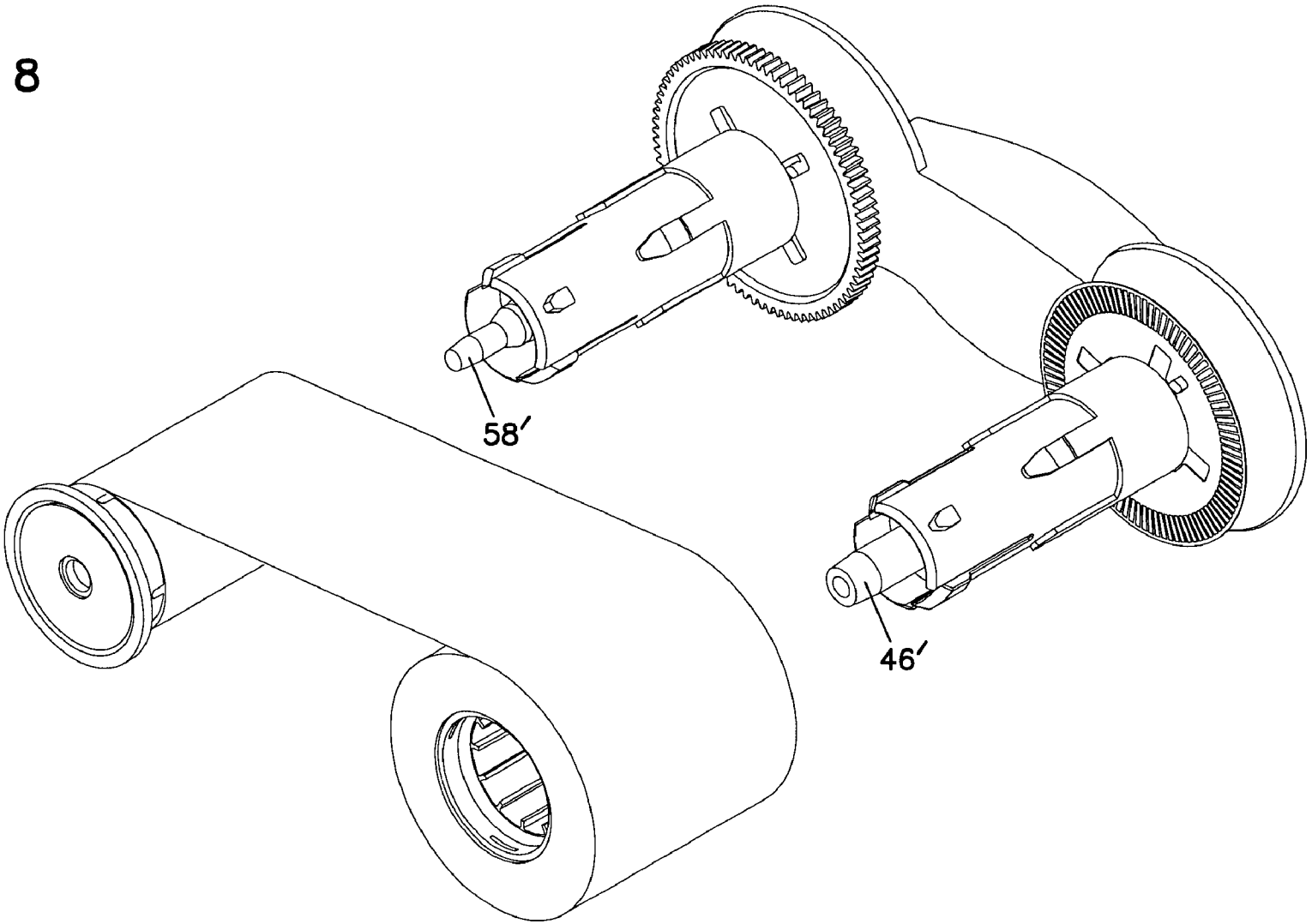
FIG. 8 illustrates an alternative embodiment of the carrier.

It is to be realized that the free ends of the pins 46, 58 could have similar shapes but different sizes. For example, as illustrated in FIG. 8, each pin 46', 58' is circular in an end plan view, with the pin 58' having a smaller diameter than the pin 46'. In addition, rather than providing the take-up cylinder with the hole 30, the supply cylinder 14 could be provided with the hole so that the cylinder 14 is only insertable onto the spindle 48 in the orientation shown, while preventing insertion of the cylinder 14 onto the spindle 60.

In addition, each cylinder 14, 18 could be provided with features to limit insertion thereof onto the respective appropriate spindle. With reference to FIG. 9, the supply cylinder is formed with a rectangular shaped hole 31 in a wall 33 of an end cap 35. The hole 31 is sized to receive a free end of the pin 46" that is rectangular in shape, while the take-up cylinder is formed with the circular shaped hole 30 for interaction with a free end of the pin 58' that is circular. In this embodiment, it is preferred that the pin 46" rotate with the supply spindle and the supply cylinder.

The use of differently shaped pins 46", 58' also alerts a user that there is a difference in the supply and take-up to make the user more wary when loading the supply item. Other shapes for the ends of the pins and the holes could also be used, for example triangular.

The openings at the ends 20*b*, 22*b* in FIG. 3 are illustrated as being of substantially the same size. However, it is also contemplated that the openings 20*b*, 22*b* at the ends could have different sizes. Further, it is contemplated that each end 20*a*, 20*b*, 22*a*, 22*b* could have different sized openings and/or different geometries to limit how the cylinders 14, 18 can be inserted onto the spindles.

The take-up cylinder 18 could also be provided with memory means to store information pertaining to the supply item as well as other information. The memory means is preferably read/write memory to permit the reading of data from and the writing of data to, the memory means. The memory means can store information pertaining to the remaining amount of ribbon left on the supply cylinder, with the ribbon remaining information being decremented in the memory means based on print jobs using information provided by the printer controller.

The memory means is preferably a radio frequency identification tag 64 mounted on the wall 26 of the cap 28. A suitable RF receiver/transmitter would be positioned in the printer adjacent to the end of the take-up cylinder 18 for reading data and writing data to the tag 64. The use and operation of RF identification tags is known from U.S. Pat. No. 6,099,178.

Figure 5:
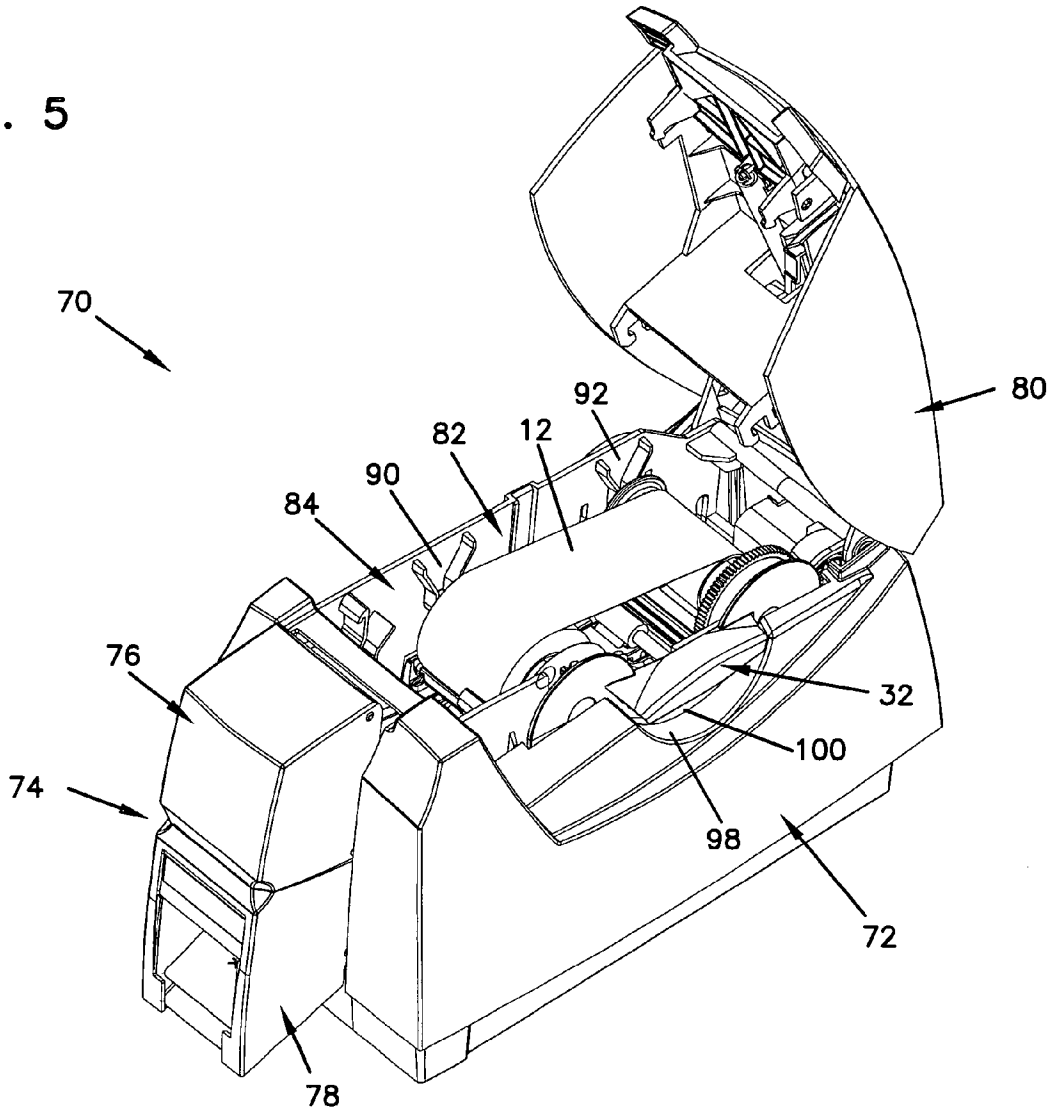
FIG. 5 is a perspective view of the print ribbon supply item and carrier disposed within a printer.
Figure 6:
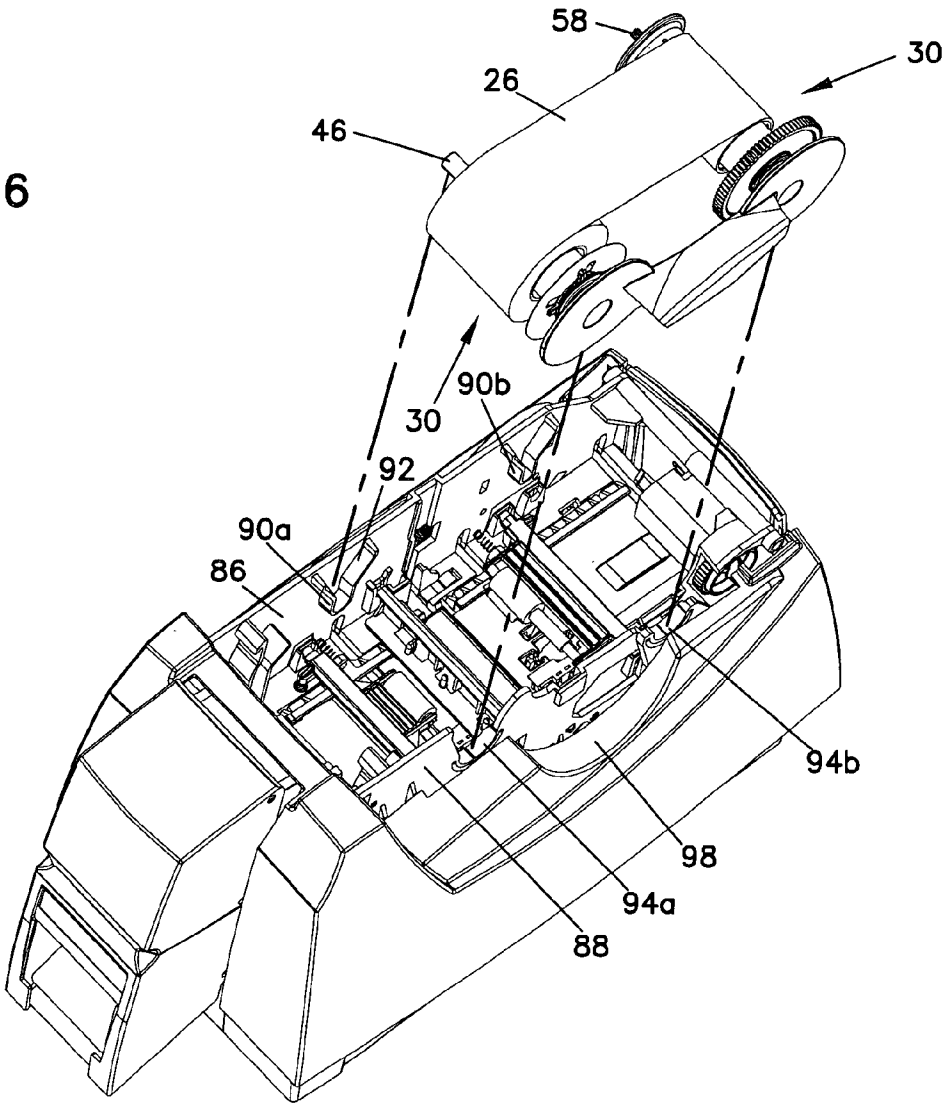
FIG. 6 is an exploded view illustrating how the print ribbon supply item and carrier are positioned in the printer.
Figure 7:
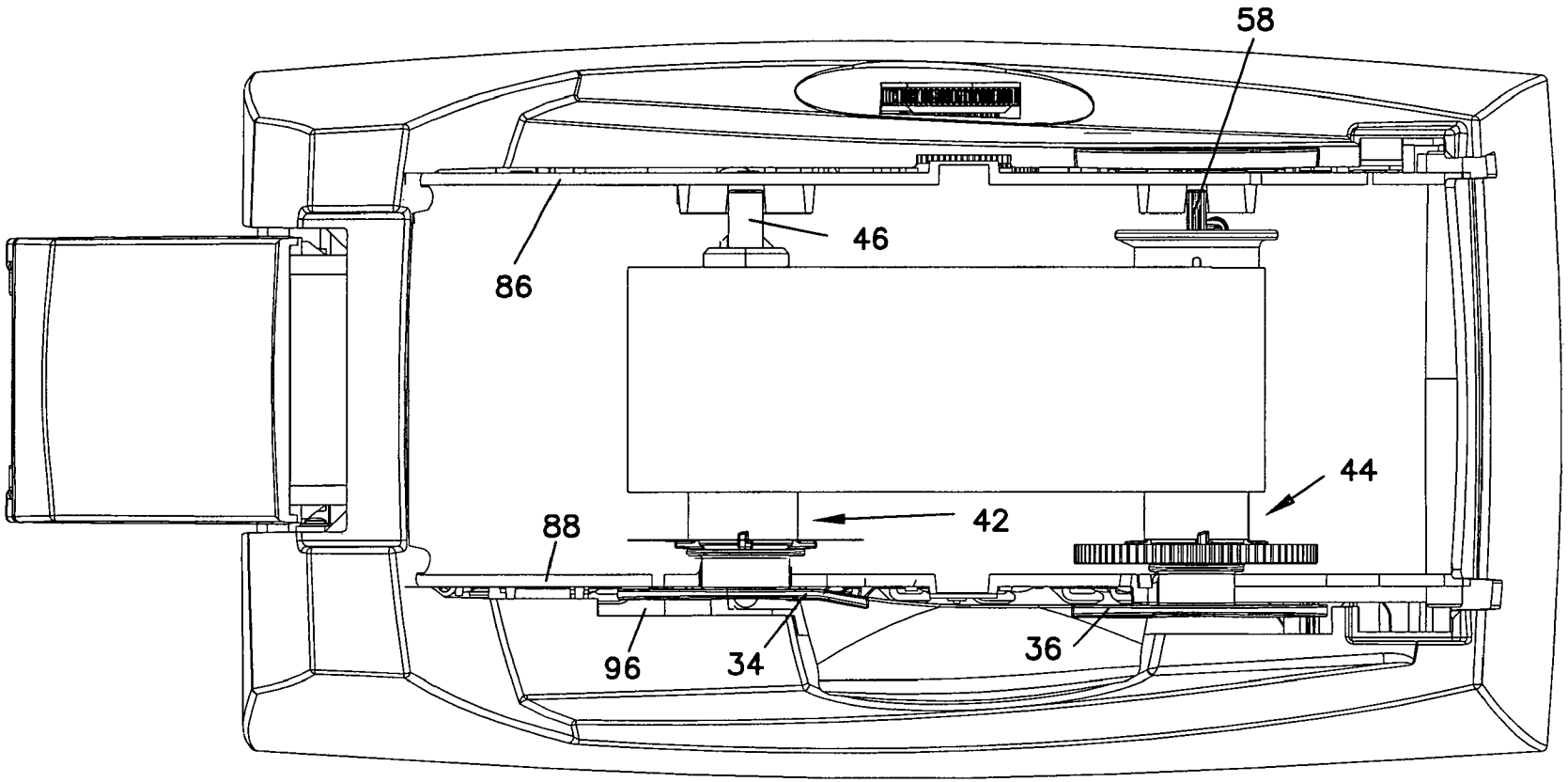
FIG. 7 is a top view of the print ribbon supply item and carrier disposed in the printer.

FIGS. 5–7 illustrate the print ribbon supply item 10 and carrier 24 in relation to a thermal printer 70. The printer 70 is related to the printer disclosed in U.S. Pat. No. 5,762,431, the entire disclosure of which is incorporated by reference. The printer 70 is used to print data and/or graphics onto plastic cards, for example financial (e.g. credit and debit) cards, drivers' licenses, national identification cards, and other cards. The printer 70 can also be provided with features to perform additional processing operations on the cards, including laminating the cards, printing bar codes, reading from and/or writing to magnetic stripes on the cards, and reading from and/or writing to an integrated circuit chip on the card.

The printer 70 comprises a housing 72 having an input/output end 74 including an input station 76 that holds a plurality of cards and that feeds cards into the printer and an output station 78 for receiving printed cards from the printer. The housing 72 includes a pivotable cover 80 that pivots between an open position, shown in FIG. 5, allowing access to the interior of the printer, including a supply item receiving area 82, and a closed position (not shown) during use of the printer 70. A printer chassis 84 is disposed within the interior of the housing 72 for supporting components of the printer. Further information on this type of printer is disclosed in U.S. Pat. No. 5,762,431.

The print ribbon 12 of the supply item 10 is supported by the carrier 24 within the area 82 of the printer 70. The print ribbon 12 is positioned to be heated by resistive dot elements on a thermal print head (not shown) which transfers thermally reactive dye or ink from the ribbon 12 to a card positioned adjacent the print head. The construction and operation of thermal print heads and print ribbons for use with thermal print heads is well known in the art.

The chassis 84 includes first and second side walls 86, 88 which define the receiving area 82 therebetween. The side wall 86 includes first and second support structures that project inward from the wall 86 for supporting the free ends of the pins 46, 58. Each support structure comprises a base section 90*a*, 90*b* that is closed at the bottom thereof to support the ends of the pins, for example pins 46, 58, thereon, and a guide section 92 composed of converging wall portions that converge toward the base section 90*a*, 90*b*. The converging construction of the guide sections 92 help to guide the respective free ends of the pins 46, 58 into the respective base sections 90*a*, 90*b*, thereby making it easier for an operator of the printer to insert the carrier 24 into the printer 70. As best shown in FIG. 7, it is preferred that the base sections 90*a*, 90*b* generally match the size of the ends of the pins 46, 58, in which case the size of the base section 90*a* for the end of the pin 46 is larger than the size of the base section 90*b* for the end of the pin 58.

As shown in FIG. 6, the side wall 88 of the chassis 84 includes cut-outs 94*a*, 94*b* that support the spindle assemblies 42, 44 of the carrier 24. In addition, as shown in FIG. 7, a gap 96 exists between the outside face of the chassis side wall 88 and the housing 72 structure. When the carrier 24 is properly positioned in the printer 70, the end regions 34, 36 and connecting plate 38 of the carrier 24 are disposed in the gap 96 between the side wall 88 and the housing, while the spindle assemblies 42, 44 and print ribbon supply item 10 are disposed on the opposite side of the side wall 88 within the receiving area 82. Shifting of the carrier 24 toward the opposite side wall 86 is prevented as a result of contact between the end regions 34, 36 and the chassis side wall 88. Thus, the end regions 34, 36 and the gap 96, along with the ends of the pins 46, 58 hitting the sidewall 88, help a person installing the supply item 10 in knowing that the carrier 24, and thus the supply item 10, are properly positioned.

Turning to FIGS. 5 and 6, the housing 72 is provided with a cut-out 98. When the carrier 24 is positioned properly, the handle portion 32 is disposed within the cut-out 98, with a gap 100 between the bottom of the handle portion 32 and the cut-out 98. The gap 100 allows room for a persons hand and/or fingers while installing or removing the carrier 24 and supply item 10. Further, the construction of the handle portion 32 is such that it fits into the cut-out 98, thereby providing an indication to the user that the carrier and supply item are properly installed.

The above specification, examples and date provide a complete description of the invention. Many embodiments of the invention, not explicitly described herein, can be made without departing from the spirit and scope of the invention.

What is claimed is:

1. A supply item for data bearing identification or financial document production equipment, comprising:

a supply cylinder having first and second ends, the first end defining a first opening having a first geometry and the second end defining a second opening;

a take-up cylinder having first and second ends, the first end of the take-up cylinder defining a first opening having a second geometry, the second geometry is different than the first geometry and the second end defining a second opening;

a web material wound onto the supply cylinder, the web material including a take-up end that is attachable to the take-up cylinder;

wherein the first end of at least one of the supply cylinder or the take-up cylinder defining an inner perimeter where the first end is partially closed when viewed in an end plan view, the first opening at the first end of the supply cylinder or the take-up cylinder being disposed within the inner perimeter, the first opening having an area less than an area of the second opening at the second end of the supply cylinder or the take-up cylinder.

2. The supply item of claim 1, wherein the first opening in the first end of the supply cylinder defines a first area, and the first opening in the first end of the take-up cylinder defines a second area, and the second area is less than the first area.

3. The supply item of claim 1, wherein the web material comprises a print ribbon.

4. The supply item of claim 3, wherein the print ribbon is a multi-color print ribbon.

5. The supply item of claim 1, wherein the web material comprises one of a cleaning ribbon, a holographic overlay, and a laminate material.

6. The supply item of claim 2, wherein the second opening of the second end of the supply cylinder defines a third area, and the second opening of the second end of the take-up cylinder defines a fourth area, and the third area is substantially equal to the fourth area.

7. The supply item of claim 2, wherein the first end of the take-up cylinder is closed by a wall, and the second geometry is defined in the wall.

8. The supply item of claim 7, wherein the wall comprises a cap that is attached to the take-up cylinder at the first end thereof.

9. The supply item of claim 2, wherein the first end of the supply cylinder is closed by a wall, and the first geometry is defined in the wall.

10. The supply item of claim 9, wherein the wall comprises a cap that is attached to the supply cylinder at the first end thereof.

11. A carrier for a supply item used in data bearing identification or financial document production equipment, comprising:

a handle portion having first and second opposite end regions;

a supply spindle rotatably mounted to the handle portion at the first end region for rotation about a first rotation axis, the supply spindle having a first end adjacent the handle portion and a second end spaced from the first end;

a first pin projecting past the second end of the supply spindle generally parallel to the first rotation axis;

a take-up spindle rotatably mounted to the handle portion at the second end region for rotation about a second rotation axis, the take-up spindle having a first end adjacent the handle portion and a second end spaced from the first end thereof; and a second pin projecting past the second end of the take-up spindle generally parallel to the second rotation axis, and, when viewed in an end plan view, the second pin has a geometry that is different than a geometry of the first pin;

wherein the first and second ends of the supply spindle being disposed on one side of the handle portion, the first and second ends of the supply spindle being disposed on the same side of the handle portion, and the first and second ends of the take-up spindle being disposed on the side of the handle portion, the first and second ends of the take-up spindle being disposed on the same side of the handle portion.

12. The carrier of claim 11, wherein, when viewed in an end plan view, the second pin has a maximum dimension that is less than a maximum dimension of the first pin.

13. The carrier of claim 12, wherein, when viewed in an end plan view, the area of the second pin is less than the area of the first pin.

14. The carrier of claim 11, further comprising a handle connected to the handle portion intermediate the end regions, and the handle comprises an upwardly curved upper surface.

15. A combination of a supply item and a carrier for the supply item for use in data bearing identification or financial document production equipment, the combination comprising:

i) a carrier having:

a) a handle portion having first and second opposite end regions;

b) a supply spindle rotatably mounted to the handle portion at the first end region for rotation about a first rotation axis, the supply spindle having a first end adjacent the handle portion and a second end spaced from the first end;

c) a first pin projecting past the second end of the supply spindle generally parallel to the first rotation axis;

d) a take-up spindle rotatably mounted to the handle portion at the second end region for rotation about a second rotation axis, the take-up spindle having a first end adjacent the handle portion and a second end spaced from the first end thereof; and e) a second pin projecting past the second end of the take-up spindle generally parallel to the second rotation axis, and, when viewed in an end plan view, the second pin has a geometry that is different than a geometry of the first pin.

ii) a supply item having:

a) a supply cylinder configured for disposition on the supply spindle of the carrier, the supply cylinder having first and second ends, the first end defining an opening having a first geometry that permits passage of the first pin;

b) a take-up cylinder configured for disposition on the take-up spindle of the carrier, the take-up cylinder having first and second ends, the first end of the take-up cylinder defining an opening having a second geometry that permits passage of the second pin, and the second geometry is different than the first geometry; and c) a web material wound onto the supply cylinder, the web material including a take-up end that is attachable to the take-up; and wherein the supply spindle being insertable through the second end toward the first end of the supply cylinder such that the first pin is receivable by the first geometry of the first end of the supply cylinder, and the take-up spindle being insertable through the second end toward the first end of the take-up spindle, such that the second pin is receivable by the second geometry of the first end of the take-up cylinder.

16. The combination of claim 15, wherein the opening in the first end of the supply cylinder defines a first area, and the opening in the first end of the take-up cylinder defines a second area, and the second area is less than the first area.

17. The combination of claim 15, wherein the web material comprises a print ribbon.

18. The combination of claim 17, wherein the web material comprises one of a cleaning ribbon, a holographic overlay, and a laminate material.

19. The combination of claim 16, wherein the first end of the take-up cylinder is closed by a wall, and the second geometry is defined in the wall.

20. The combination of claim 19, wherein the wall comprises a cap that is attached to the take-up cylinder at the first end thereof.

21. The combination of claim 16, wherein the first end of the supply cylinder is closed by a wall, and the first geometry is defined in the wall.

22. The combination of claim 21, wherein the wall comprises a cap that is attached to the supply cylinder at the first end thereof.

23. The combination of claim 17, wherein the second ends of the supply cylinder and the take-up cylinder defining an opening therein, and where the first end of at least one of the supply cylinder or the take-up cylinder defining an inner perimeter where the first end is partially closed when viewed in an end plan view, the opening at the first end of the supply cylinder or the take-up cylinder being disposed within the inner perimeter, the opening at the first end having an area less than an area of the opening at the second end of the supply cylinder or the take-up cylinder.

24. The combination of claim 17, wherein the supply item being loaded on the spindles of the carrier on one side of the carrier.

* * * * *